United States Patent [19]

Woolenweber

[11] Patent Number: 4,790,272

[45] Date of Patent: Dec. 13, 1988

[54] NON-CIRCULAR POPPET VALVES FOR INTERNAL COMBUSTION ENGINE CYLINDER ASSEMBLIES

[76] Inventor: William E. Woolenweber, 3169 Camino del Arco, La Costa, Calif. 92009-7856

[21] Appl. No.: 108,456

[22] Filed: Oct. 15, 1987

[51] Int. Cl.[4] ..... F01L 3/10

[52] U.S. Cl. ..... 123/188 B; 123/188 A; 123/188 AA; 251/356

[58] Field of Search ..... 123/188 R, 188 B, 188 AA, 123/188 M, 190 BB, 190 BC, 190 BE; 251/356, 336

[56] References Cited

U.S. PATENT DOCUMENTS

| | | | |
|---|---|---|---|
| 223,374 | 1/1880 | Wodre | 251/356 |
| 1,624,992 | 4/1927 | Spillman | 123/188 B |
| 4,164,209 | 8/1979 | Grands | 123/188 B |

FOREIGN PATENT DOCUMENTS

| | | | |
|---|---|---|---|
| 0101293 | 2/1984 | European Pat. Off. | 123/188 B |
| 2349880 | 4/1975 | Fed. Rep. of Germany | 123/188 B |

*Primary Examiner*—Raymond A. Nelli

*Attorney, Agent, or Firm*—Willian Brinks Olds Hofer Gilson & Lione

[57] ABSTRACT

A new internal combustion engine cylinder and valve assembly includes one or more valve openings and valves having a non-circular periphery. The non-circular valve openings and valves increase the flow-through area across the engine intake and exhaust valves, increasing the air quantity available in the cylinder assembly for combustion. The increased air quantity available through the non-circular valve opening and valves reduces the throttling loss experienced by the cylinder assembly, increases the extent of combustion of the air-fuel mixture introduced into the cylinder assembly, reduces engine pumping losses, increases the power output of the engine, reduces the amount of residual hydrocarbons and carbon monoxide present in the exhausted gases, and provides overall a more efficient internal combustion engine cylinder and valve assembly, particularly where such engines are turbocharged.

8 Claims, 3 Drawing Sheets

NON-CIRCULAR POPPET VALVES FOR INTERNAL COMBUSTION ENGINE CYLINDER ASSEMBLIES

BACKGROUND OF THE INVENTION

This invention relates to internal combustion engine cylinder assemblies and their associated valve openings and poppet valves for the intake and exhaust of an air-fuel mixture.

The thermal efficiency and fuel consumption of an internal combustion engine are very important factors in the overall cost of operation of the engine. As the cost of engine fuel increases, the emphasis on improving the fuel consumption of an engine also increases. Better fuel economy has become a major objective of research and development programs being carried on by major engine manufacturers today. Further effort is being targeted at obtaining a greater quantity of air into the cylinder assembly during the intake stroke which then can be utilized to either produce more power for the engine or lower the fuel consumption of the engine, or a combination of both.

Common methods of increasing the air quantity available in the cylinder assembly for combustion are supercharging the cylinder assembly through the use of mechanically driven blowers, and, more commonly, turbochargers, cooling the air by water to air, or air to air, heat exchangers, using quick opening cams to reduce the throttling loss through the intake valve, and so forth.

The variable that relates to the amount of charged air in the cylinder assembly is volumetric efficiency. Volumetric efficiency is a measure of the actual quantity of air in the cylinder assembly at the end of the intake process compared to the amount of air that could be in the cylinder assembly at normal atmospheric temperature and pressure.

Normally aspirated engines (non-supercharged) must necessarily have a volumetric efficiency of less than one hundred percent (100%) because of heat transferred to the air as it passes through the intake valve and enters the cylinder assembly and a pressure drop due to losses in passing through the narrow opening around the valve. Both the heat transfer and pressure drop due to the restricted valve opening reduce the quantity of air in each cylinder to less than that represented by atmospheric condition. The fuel consumption of diesel engines is usually improved by providing more excess air than required by the chemically correct mixture of air and fuel (stoichiometric mixture), however, any design feature that improves volumetric efficiency can be used to reduce fuel consumption in an internal combustion engine.

Providing an excess quantity of air also reduces noxious emissions. More complete combustion of the air-fuel mixture reduces the amount of residual hydrocarbons and carbon monoxide present in the exhausted mixture. More air in the cylinder assembly usually lowers the maximum temperature of combustion, thus reducing the amount of nitrogen oxide formed in the cylinder assembly which subsequently escapes in the exhaust gases.

In supercharged engines, the amount of air forced into the cylinder assembly generally exceeds the amount that could be present at normal atmospheric temperature and pressure so that the volumetric efficiency of this type of engine is usually greater than one hundred percent (100%). However, since the intake manifold pressure is increased to levels much above atmospheric by the supercharger, the pressure loss in the air passing through the intake valve is increased substantially. If the throttling loss across the valve can be reduced by valve design, then the supercharger pressure can be lowered. This in turn would lower the power absorbed in driving the supercharger from the engine and reduce the engine fuel consumption for the same power output of the engine.

The throttling loss through the intake valve is even more important in turbocharged engines than in supercharged engines. As the combusted mixture is exhausted through the exhaust valve, another pressure loss occurs. The pressure loss across the exhaust valve in such an engine is of more concern because it also affects the amount of exhaust gas energy available to drive the turbocharger turbine. When the exhaust valve starts to open, there is a very high residual pressure existing in the cylinder assembly near the end of the power-producing expansion stroke. Since the prevailing pressure in the exhaust manifold is much lower, there is a large pressure drop across the exhaust valve during the first part of the opening of the valve. This represents a large loss of energy in the exhaust gas that cannot be recovered and that cannot be used by the turbocharger turbine. Later in the exhaust stroke, the upward motion of the piston forces the residual exhaust gases out through the open exhaust valve into the exhaust manifold with a further loss in energy due to the small flow-through area around the valve head. The overall result of these conditions causes a substantial reduction in the pressure available to the turbocharger turbine from the pressure that was present in the cylinder assembly as the exhaust valve begins to open and as the exhaust gases flow out through the valve opening and expand into the exhaust manifold. The turbocharger turbine is driven by a pressure drop across its blading to produce power and higher pressures at the turbine inlet produce more turbine power and higher turbine outputs. Nozzles are provided in the turbine casing to recover valve pressure losses and raise the gas pressure from the exhaust manifold and obtain satisfactory power levels from the turbocharger turbine. The nozzles, however, introduce back pressure on the cylinders and increase engine pumping losses. If more of the gas pressure of the engine cylinders can be preserved prior to the turbocharger turbine nozzle, then the turbine nozzle area can be increased. The result of larger nozzle area in the turbocharger turbine is a lower average back pressure on the engine cylinder assemblies, a lower engine pumping loss, and a reduction in engine fuel consumption.

Current internal combustion machines utilize intake and exhaust valves that have round peripheries. Two valves per cylinder, one intake and one exhaust, are commonly used. However, many modern engines use a four valve per cylinder assembly configuration to increase the total flow-through area across the valves and produce the benefits of reduced valve losses that have been previously described. An increase in flow area of approximately fifty to sixty percent can be expected in a given cylinder assembly by using four valves versus two valves; however, the use of four valves rather than two valves significantly increases the cost of the valve assembly and valve operating mechanism. A recent study by a Japanese engine manufacturer focused on the optimization of multi-valve engine designs; the study analyzed four, five, six and seven-valve designs and concluded the five-valve design to be most efficient, further complicating the valve assembly and valve mechanism. However, the study considered only conventional internal combustion engines having valves with round peripheral shapes. The use of round valve heads in a round cylinder assembly, however, does not permit the use of maximum available flow-through area in either the intake or exhaust port and also does not optimize the volumetric efficiency of the cylinder assembly.

SUMMARY OF THE INVENTION

This invention comprises an internal combustion engine cylinder assembly, and particularly the valve assembly, having one or more poppet valve openings and poppet valves with each poppet valve opening and poppet valve having a non-circular periphery. Non-circular periphery means the periphery of any poppet valve and poppet valve seat which has a circumferential length greater than that provided by a circular valve and valve seat. Examples include valve seats having peripheries with linear and semicircular portions extended to conform to the outer periphery of the internal combustion engine cylinder. In preferred embodiments the valve openings and intake and exhaust valve heads of the cylinder assembly can have a semi-circular periphery, a quadri-circular periphery, or an oval periphery.

The non-circular peripheral shape of the valve openings and valves increases the flow-through area available for air entering the cylinder and for the combusted fuel-air mixture leaving the cylinder. To maintain the structural strength of the cylinder head and prevent the shape of the combustion chamber from flattening, a minimum clearance between the valve seats and between the valve seats and the periphery of the cylinder must be maintained. Merely trying to increase the diameter of a circular valve is impractical, as was concluded by the aforenoted Japanese study.

In the invention, however, the flow-through area of the valves is substantially increased by the use of non-circular valve peripheries that closely follow the periphery of the engine cylinders. Such valves include quadri-circular, semi-circular and oval shapes. The valve opening area, or flow-through area, may be maximized by such a shape.

This invention provides a more efficient internal combustion engine cylinder assembly by providing for an improvement in fuel consumption, power output, as well as a reduction in noxious emissions in the exhaust gases.

DETAILED DESCRIPTION OF THE PREFERRED EMBODIMENTS

A conventional overhead valve assembly and conventional intake and exhaust valves of an internal combustion engine are illustrated by FIG. 1 through FIG. 4.

Figure 1:
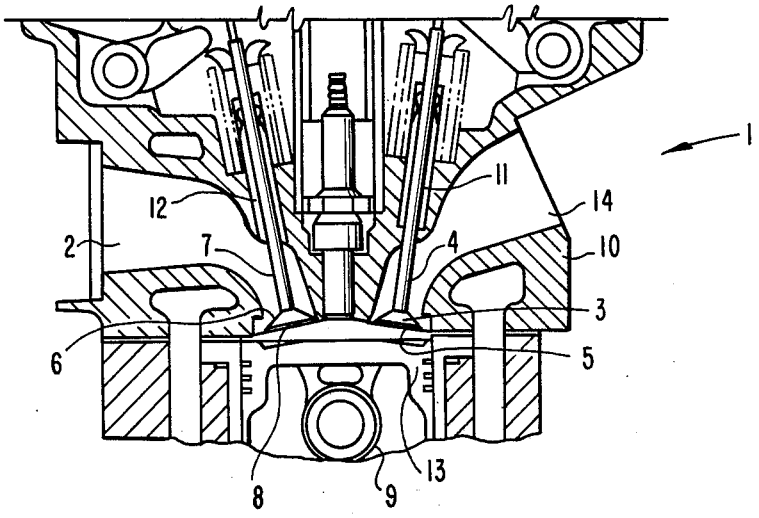
FIG. 1 is a partial cross-sectional view of an overhead valve assembly and cylinder head of an internal combustion engine.

Turning specifically to FIG. 1, an overhead valve assembly and cylinder head 1 of an internal combustion engine includes generally a piston 9 adapted to be driven by an air-fuel mixture introduced through an intake passage 14 of a cylinder head 10, passing through an intake valve port opening 5 and combusting in a combustion chamber 13. Combusted gases are exhausted through an exhaust valve port opening 8, passing through an exhaust passage 2. The intake valve port opening and exhaust valve port opening are opened and closed by valve heads 3 and 6, respectively. The valve heads are operated by valve stems 4 and 7; the valve stems are aligned by valve guides 11 and 12.

Figure 2:
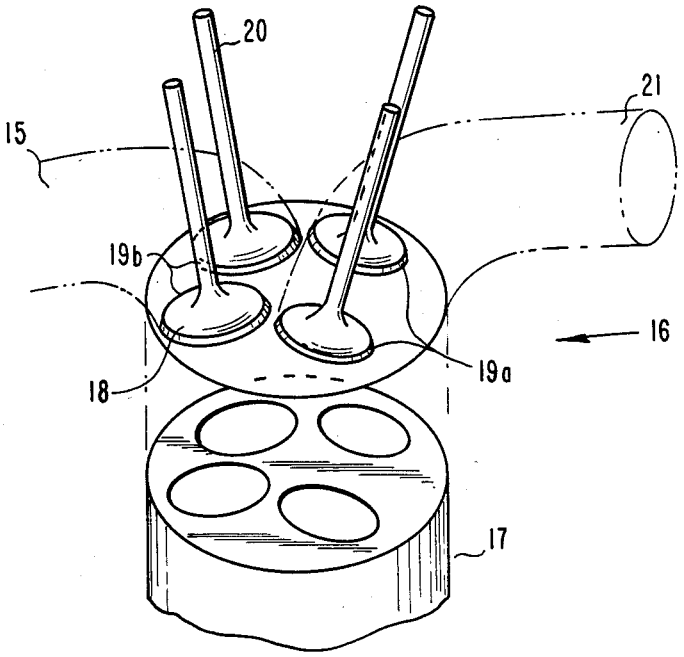
FIG. 2 is a schematic representation showing the valves and piston of FIG. 1.

FIG. 2 shows a partial view of a conventional overhead valve assembly and cylinder head 16 of an internal combustion engine in which there appear four valve heads 18 and four valve port openings 19, each of four valve heads being controlled by a valve stem 20. Each of the four valve port openings 19 are opened and closed by the four valve heads 18. The air-fuel mixture is introduced into the cylinder assembly 16 through intake passage 21 and intake valve port openings **19*a* into the combustion chamber 17. After combustion, the gases are exhausted through exhaust valve port openings 19*b* and exhaust passage 15**. Each of the four valve heads and each of the four valve port openings is of a circular periphery.

Figure 3:
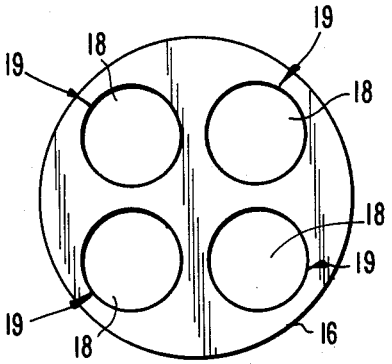
FIG. 3 is a schematic view of a portion of the internal overhead valve assembly of FIG. 1 and FIG. 2 showing its four-valve configuration, each valve having a circular periphery.

FIG. 3 shows a partial view of the conventional overhead valve assembly of FIG. 2. As shown in FIG. 3, the four valve port openings 19, and the four valve heads 18 are of a circular periphery.

Figure 4:
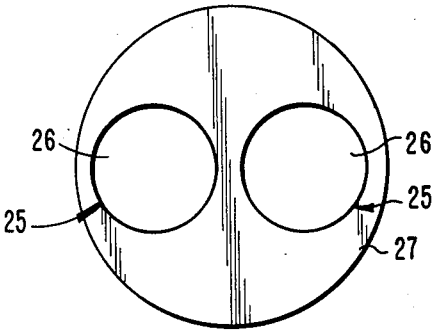
FIG. 4 is a schematic view of a portion of an overhead valve assembly using a two-valve configuration, each valve having a circular periphery.

FIG. 4 shows a conventional overhead valve assembly and cylinder head 27 of an internal combustion engine using a two-valve configuration, each of the two valve heads 26 and each of the two valve port openings 25 is of a circular periphery.

Figure 5:
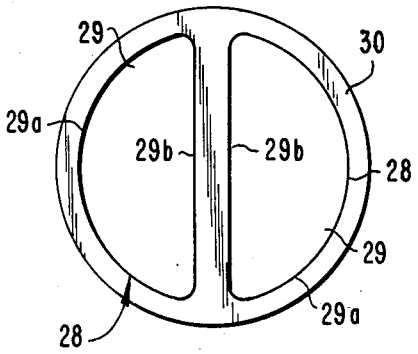
FIG. 5 is a schematic view of a portion of an overhead valve assembly using a two-valve configuration of this invention, each valve having a semi-circular periphery.
Figure 6:
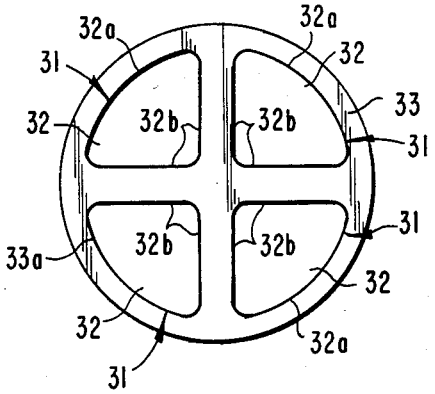
FIG. 6 is a schematic view of a portion of an overhead valve assembly using a four-valve configuration of this invention, each valve having a quadri-circular periphery.
Figure 7:
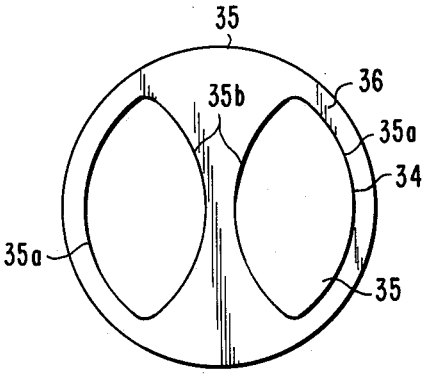
FIG. 7 is a schematic view of a portion of an overhead valve assembly using a two-valve configuration, each valve having an oval periphery.
Figure 9:
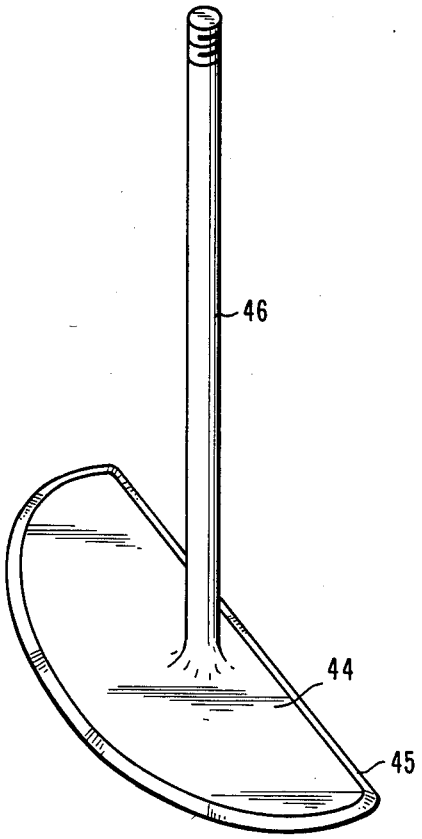
FIG. 9 is a drawing of a valve of this invention with a non-circular periphery.

FIGS. 5, 6 and 7 illustrate valves and valve openings of non-circular periphery for an overhead valve assembly of an internal combustion engine incorporating this invention. Generally such an overhead valve assembly has one or more valve port openings through which an air-fuel mixture is introduced and the combusted air-fuel mixture is exhausted. Each of the one or more valve openings has a valve for opening and closing the valve opening comprising a valve stem and a valve head of non-circular periphery attached at one end of the valve stem, as shown in FIG. 9. The peripheries of each one or more valve port openings and their associated valves are of identical non-circular shapes (i.e., the periphery of each valve port opening is identical to the periphery of its corresponding valve head) to block the passage of gases through the valve while it is in the closed position.

FIG. 5 shows an overhead valve assembly 30 of an internal combustion engine using a two-valve configuration, each valve head 29 and valve port opening 28 having a semi-circular periphery portion 29*a* located adjacent the periphery of the cylinder and linear periphery portion 29*b* adjacent the center of the cylinder.

FIG. 6 shows an overhead valve assembly 33 of an internal combustion engine using a four-valve configuration with each valve head 32 and valve port opening 31 having a quadri-circular periphery portion 32*a* located adjacent the periphery of the cylinder and two linear periphery portions 32*b* interiorly of the cylinder.

FIG. 7 shows an overhead valve assembly 36 of an internal combustion engine using a two-valve configuration, each valve head 35 and valve port opening 34 having an oval periphery portion 35*a* located adjacent to the periphery of the cylinder and an oval periphery portion 35*b* interiorly of the cylinder.

Figure 8:
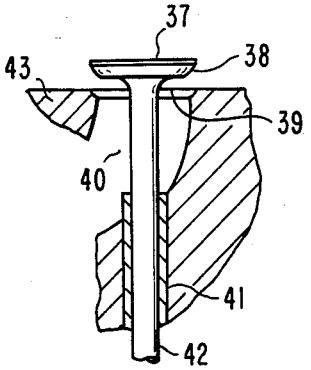
FIG. 8 is a schematic view of a single engine valve and related parts which may serve as an intake or exhaust valve in a valve assembly.

FIG. 8 shows an internal combustion engine valve situated in a cylinder head 43. This particular valve may serve as an intake or exhaust valve and consists of a stem 42, led through valve guide 41 connected to the head 37 of the valve. Valve head 37 is partially beveled on the undersurface to provide a valve face 38 that mates with the valve seat 39 while in the closed position. The air-fuel mixture is aspirated or exhausted through passage 40.

FIG. 9 shows a non-circular valve for a valve assembly incorporating this invention and having a stem 46 connected to valve head 44. Valve face 45 is received by the valve seat (not shown) while in the closed position. The periphery of this particular embodiment includes a semi-circular shape.

Figure 10B:
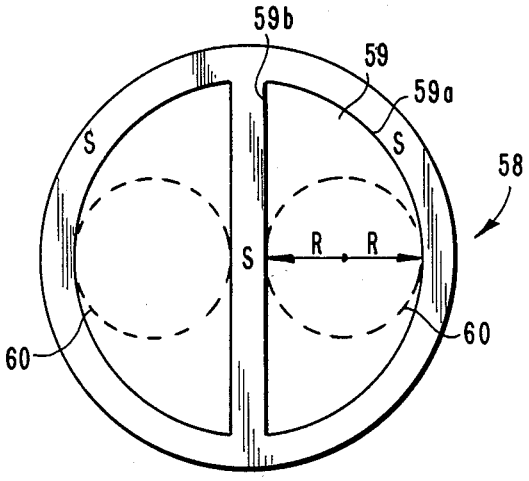
FIG. 10B is a schematic view of a portion of an overhead valve assembly of this invention using a two-valve configuration of this invention, each valve having a semi-circular periphery like FIG. 5, except in each valve head a circular valve shape is inscribed to illustrate the invention.
Figure 10A:
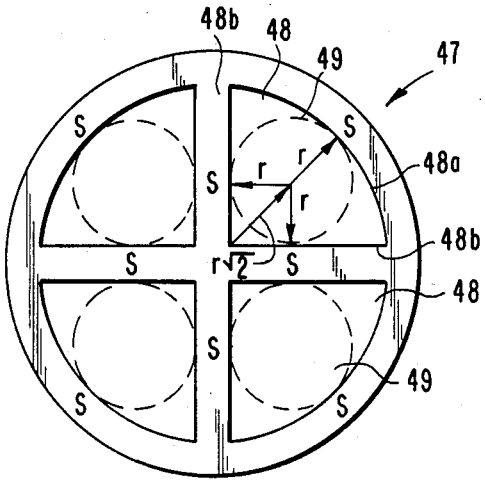
FIG. 10A is a schematic view of a portion of an overhead valve assembly using a four-valve configuration of this invention, each valve having a quadri-circular periphery like FIG. 6, except in each valve head a circular valve shape is inscribed to illustrate the invention.

FIG. 10A is a schematic view of a portion of an overhead valve assembly 47 using a four-valve configuration of this invention, each valve port opening and valve head 48 having a quadri-circular periphery in each of which is inscribed a circular valve shape 49 for purposes of illustration. For a given necessary separation "s" between the peripheries of each valve head with respect to each other and the periphery of the cylinder, FIG. 10A permits an illustration of the increased flow-through area of this invention.

The flow-through area for a circular valve is calculated by the following formula:

$$Fi=2\pi r\times h$$

where;

Fi=valve flow-through area
r=valve radius
h=maximum valve lift

This is basically the peripheral length of the valve port opening multiplied by the height to which the valve opens. For a circular valve the flow-through area is merely a measure of the surface area of a cylindrical shape with its diameter equaling that of the valve port opening and with its height equaling the maximum lift of the valve head.

Mathematics can establish that the peripheral length of a non-circular valve is substantially greater than the circumference of a circular valve whose periphery can be inscribed within the non-circular valve. This is illustrated in FIG. 10A, showing the overhead valve assembly 47 having four quadri-circular valves 48, in each of which is inscribed a circular valve outline 49. As aforenoted, a minimum separation distance "s" between the valve seats and the periphery of the cylinder must be maintained to prevent the weakening and flattening of the combustion chamber. Therefore, the outer peripherals of the circular shape and the quadri-circular shape coincide at certain points.

As shown in FIG. 10A, if the inscribed circle 49 has a radius "r", the radius of the outer quadri-circular portion is somewhat greater than $r+(\sqrt{2}\times r)$, or about 2.414r, and the length of the quadri-circular periphery 48*a* of the valve 48 is $2\times\pi\times 2.414r$ divided by 4, or about 3.79r. The lengths of the two linear periphery portions 48*b* are each about 2.414r and, therefore, the total peripheral length of the non-circular periphery of quadri-circular valve 48 is about 3.79r+4.828r, r about 8.6r. By comparison, the total length of a circular valve which would maintain the same separation "s" in an internal combustion engine is $2\times\pi\times r$, or 6.28r. Thus, the use of a non-circular periphery valve of quadri-circular form, such as that shown in FIGS. 6 and 10A, permits about a 36% increase in the peripheral lengths, and therefore the flow-through areas, of the openings through which fuel and air are delivered to the cylinders of the internal combustion engine and through which the combusted exhaust gas is delivered to the exhaust manifold.

FIG. 10B is a schematic view of a portion of an overhead valve assembly 58 using a two-valve configuration of this invention, each valve port opening and valve head 59 having a semi-circular periphery, in each of which is inscribed a circular valve shape 60 for purposes of illustration which maintains the minimum separation distance "s" between the peripheries of each valve head with respect to each other and the periphery of the cylinder.

If the circular periphery 60 inscribed within the semi-circular periphery 59 is defined by radius , the radius of the semi-circular periphery 59*a* is about twice the radius R, or 2R, and the length of the semi-circular periphery 59*a* is about $2\times\pi\times 2R$ divided by 2, or $2\pi r$. Linear portion 59*b* is equal to about four times the radius R, or 4R. Thus, the peripheral length of the semi-circular valve 59 is about $4R+2\pi R$, or about 10.28R. By comparison, the peripheral length of a circular valve in a two valve configuration that maintains the same minimum separation "s" will be $2\times\pi\times R$, or about 6.28R. Thus, the circumference of the semi-circular periphery is about 64% greater than that of the valve having a circular periphery. Such an increase is comparable to and possibly greater than that achieved with four circular valves and without the additional parts and mechanism necessary to operate four valves. Such increased flow-through areas are also obtained with oval shape valves, such as shown in FIG. 7.

The length of the circumference of the noncircular valves are greater than the linear circumference of the circular valves. Assuming the lift of the valve to be constant and remembering that the valve flow-through area is calculated by multiplying the lift of the valve by the peripheral length of the valve, non-circular valves having greater peripheral lengths than the circular valves provide greater flow-through areas.

The increased flow-through area obtained by such non-circular intake valve port openings and valve heads allow for a greater quantity of air to enter the combustion chamber, resulting in greater volumetric efficiency, less heat transfer to the air, and decreased pressure loss as the air passes through the valve opening. The excess air provided in the combustion chamber reduces the fuel consumption of the internal combustion engine, lowering the maximum temperature of combustion. The excess air further provides for more complete combustion of the air-fuel mixture, thus reducing the amount of residual hydrocarbons and carbon monoxide present in the combusted mixture and exhausted through the exhaust port and passing through the exhaust manifold.

As the air enters the combustion chamber through such non-circular intake valves, the pressure loss incurred across the valve is lower than that incurred by conventional circular valves. If the pressure loss across the intake valve is reduced, the power required to drive superchargers can be lowered, resulting in a reduction of the power absorbed in driving the supercharger and an increase in fuel consumption efficiency for the same power output of the engine. In like manner, the output pressure of the compressor of a turbocharger can also be reduced, or the pressure delivered by the turbocharger compressor can be increased at the cylinders.

The increased flow-through area obtained with such non-circular exhaust valves is also advantageous after combustion because of the reduced pressure loss as the gaseous mixture is exhausted through the exhaust valve. The reduced pressure loss across the exhaust valve in turbocharged engines increases the exhaust gas energy available to drive the turbocharger turbine. The increased flow-through area of the non-circular exhaust valve reduces this pressure loss and preserves more of the cylinder exhaust gas pressure available at the turbocharger turbine nozzle. This allows for the use of an increased turbine nozzle area, reducing the average back pressure on the pistons and lowering the engine pumping loss and fuel consumption.

While I have shown preferred embodiments, other embodiments may be devised incorporating the invention described above without departing from the spirit and scope of the following claims.

I claim:

1. Means forming an internal combustion engine having one or more cylinder assemblies containing pistons, adapted to be driven by an air-fuel mixture introduced into the one or more cylinder assemblies through one or more valve openings for combustion and adapted to expel the combusted air-fuel mixture from the cylinder assembly through said one or more valve openings, each of said one or more valve openings having a poppet valve to open and close the valve opening, at least one of said one or more vale openings and poppet valves having a non-circular periphery.

2. The internal combustion engine cylinder assembly of claim 1 including two valve openings and two poppet valves for each cylinder wherein each of the said two valve openings and two poppet valves has a semi-circular periphery located adjacent the periphery of the cylinder.

3. The internal combustion engine cylinder assembly of claim 1 including four valve openings and four poppet valves for each cylinder wherein each of the said four valve openings and four poppet valves has a quadri-circular periphery located adjacent the periphery of the cylinder.

4. The internal combustion engine cylinder assembly of claim 1 wherein each said one or more poppet valve openings and one or more poppet valves has an oval periphery located adjacent the periphery of the cylinder.

5. A poppet valve for an internal combustion engine, comprising a valve stem and a valve head provided at one end of the valve stem, said valve head having a non-circular periphery.

6. A poppet valve for an internal combustion engine, comprising a valve stem and a valve head attached at one end of the valve stem, said valve head having a quadri-circular periphery.

7. A poppet valve for an internal combustion engine, comprising a valve stem and a valve head attached at one end of the valve stem, said valve head having a semi-circular periphery.

8. A poppet valve for an internal combustion engine, comprising a valve stem and a valve head attached at one end of the valve stem, said valve head having an oval or elliptical periphery.

* * * * *

UNITED STATES PATENT AND TRADEMARK OFFICE

CERTIFICATE OF CORRECTION

PATENT NO. : 4,790,272

DATED : December 13, 1988

INVENTOR(S) : William E. Woollenweber

It is certified that error appears in the above-identified patent and that said Letters Patent is hereby corrected as shown below:

On the title page delete "Woolenweber" and insert --Woollenweber-- therefor; after "[76] Inventor: William E.", delete "Woolenweber" and insert --Woollenweber-- therefor. William E. Woollenweber is the inventor's name.

In col. 8, line 15 (claim 1, line 10), delete "vale" and insert --valve-- therefor.

Signed and Sealed this

Sixth Day of June, 1989

*Attest:*

*Attesting Officer*

DONALD J. QUIGG

*Commissioner of Patents and Trademarks*